US006959893B1

(12) United States Patent
Sadowski et al.

(10) Patent No.: US 6,959,893 B1
(45) Date of Patent: Nov. 1, 2005

(54) LIGHT FIGHTER LETHALITY SEEKER PROJECTILE

(75) Inventors: Lucian M. Sadowski, Stroudsburg, PA (US); Sung K. Chung, Dover, PA (US); John H. Whiteside, Elkridge, MD (US); Tomas Cincotta, Lorton, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 282 days.

(21) Appl. No.: 10/604,898

(22) Filed: Aug. 26, 2003

Related U.S. Application Data

(60) Provisional application No. 60/320,073, filed on Apr. 1, 2003.

(51) Int. Cl.[7] ..... F42B 15/01; F42B 12/02

(52) U.S. Cl. ..... 244/3.16; 244/3.1; 244/3.15; 244/3.24; 244/3.27; 102/305; 102/306; 102/308; 102/501

(58) Field of Search ..... 244/3.1–3.3; 89/1.11; 102/501–529, 301, 305–310, 374, 377, 378, 102/382, 386, 388, 396, 397, 430, 438, 439, 102/473, 475, 476, 478, 489, 499, 500, 204, 102/206–220, 221, 222, 254–261, 272–275; 342/61–62

(56) References Cited

U.S. PATENT DOCUMENTS

| | | | | |
|---|---|---|---|---|
| 2,804,823 A | * | 9/1957 | Jablansky | 102/377 |
| 4,714,022 A | * | 12/1987 | Chaumeau et al. | 102/476 |
| 4,803,928 A | * | 2/1989 | Kramer et al. | 102/476 |
| 4,854,240 A | * | 8/1989 | Hirsch et al. | 102/476 |
| H867 H | * | 1/1991 | Hill | 102/374 |
| 5,003,883 A | * | 4/1991 | Mixon et al. | 102/476 |
| 5,166,469 A | * | 11/1992 | Kerdraon et al. | 102/210 |
| 5,180,882 A | * | 1/1993 | Bansard | 102/216 |
| 5,198,615 A | * | 3/1993 | Robbie et al. | 102/476 |
| 5,309,843 A | * | 5/1994 | Rentzsch et al. | 102/476 |
| 5,415,105 A | * | 5/1995 | Voss et al. | 102/476 |

(Continued)

FOREIGN PATENT DOCUMENTS

EP 1116930 A1 * 7/2001 ..... F42B 12/18

OTHER PUBLICATIONS

"Bill 2 Anti-Tank Guided weapon"; no author given; no date given; posted on the Internet at army-technology.com.*

*Primary Examiner*—Bernarr E. Gregory
(74) *Attorney, Agent, or Firm*—Michael C. Sachs; John F. Moran

(57) ABSTRACT

A projectile comprises an imaging seeker at a front of the projectile; a front warhead behind the imaging seeker; a power supply; an electronics unit connected to the power supply and comprising a microprocessor circuit board, a voltage regulator circuit board, an inertial measurement circuit board and a fuze and safe and arm circuit board, all electrically connected to each other, the microprocessor circuit board also being connected to the imaging seeker; a rear warhead, the front and rear warheads being electrically connected to the safe and arm circuit board; a rocket motor electrically connected to the electronics unit; foldable fins mounted at the rear of the projectile; a shell that encases the front warhead, the power supply, the electronics unit, the rear warhead and the rocket motor; and a maneuver mechanism disposed in the shell and electrically connected to the microprocessor circuit board.

18 Claims, 3 Drawing Sheets

U.S. PATENT DOCUMENTS 5,526,752 A * 6/1996 Dahl et al. ..... 102/517
5,834,684 A * 11/1998 Taylor ..... 102/517
5,952,604 A * 9/1999 Helander ..... 102/476
5,988,071 A * 11/1999 Taylor ..... 102/473
6,021,716 A * 2/2000 Taylor ..... 102/517

* cited by examiner

LIGHT FIGHTER LETHALITY SEEKER PROJECTILE

CROSS REFERENCE TO RELATED APPLICATIONS

This application claims benefit under 35 U.S.C. 119(e) of provisional application 60/320,073, filed Apr. 1, 2003, the entire file wrapper contents of which provisional application are herein incorporated by reference as though fully set forth at length.

FEDERAL RESEARCH STATEMENT

The inventions described herein may be manufactured, used and licensed by or for the U.S. Government for U.S. Government purposes.

BACKGROUND OF INVENTION

The invention relates in general to munitions and, in particular, a gun launched, small caliber, autonomous, seeker assisted, guided projectile.

In the past, infantrymen engaged personnel targets with rifles that fired unguided projectiles. Firing on a moving target with a non-maneuvering projectile resulted in a low probability of hit, while the probability of hit for a target in defilade was zero. The introduction of shoulder fired, fragmenting grenades resulted in a higher probability of hit (by a fragment) against stationary targets. The probability of a hit against a moving target, or a target that went into defilade after projectile launch, remained quite low. There are several approaches currently used for these problems: (1) use a lead computing sight for moving targets, (2) use an automatic target tracker to follow the target while moving and mark its position in sight image space when the target went into defilade, and (3) use the output of an automatic target tracker to drive an off-boresight laser range finder to derive the range to the last observed position before the target moved into defilade, then use this information to derive aiming data for a sight.

The use of a lead computing sight requires a stabilized platform. Because a shoulder fired weapon is semi-stabilized at best, this potential solution is not satisfactory. The use of an automatic target tracker together with marking a target's last observed position in image space improves hit probability for an airburst fuzed grenade, but does not improve hit probability against a target which continues to move, and does not compensate for the effect of non-standard atmospheric conditions (primarily range and cross wind). Adding an off-boresight laser range finder to an automatic target tracker improves hit probability for both moving and move to defilade targets by improving the burst time accuracy for airburst fuzed grenades, but fails to compensate for aim error or for the effect of non-standard atmospheric conditions on flight time and deflection.

The present invention compensates for both aiming error and target motion after launch by locating the target in sequential images of the target area, while in flight, and using this information, plus information from an on-board guidance and control system, to alter the initial projectile trajectory. The influence of non-standard atmospheric conditions on the trajectory are compensated for by the same means, increasing the probability of hit. The present invention also increases the probability of hit against a moving target, or a target that goes into defilade after launch, by incorporating an adaptive, air burst fuze. Fuze function time is corrected from the launch setting by information from the imaging seeker and the guidance and control system.

The invention will be better understood, and further objects, features, and advantages thereof will become more apparent from the following description of the preferred embodiments, taken in conjunction with the accompanying drawings.

BRIEF DESCRIPTION OF DRAWINGS

In the drawings, which are not necessarily to scale, like or corresponding parts are denoted by like or corresponding reference numerals.

DETAILED DESCRIPTION

Figure 1:
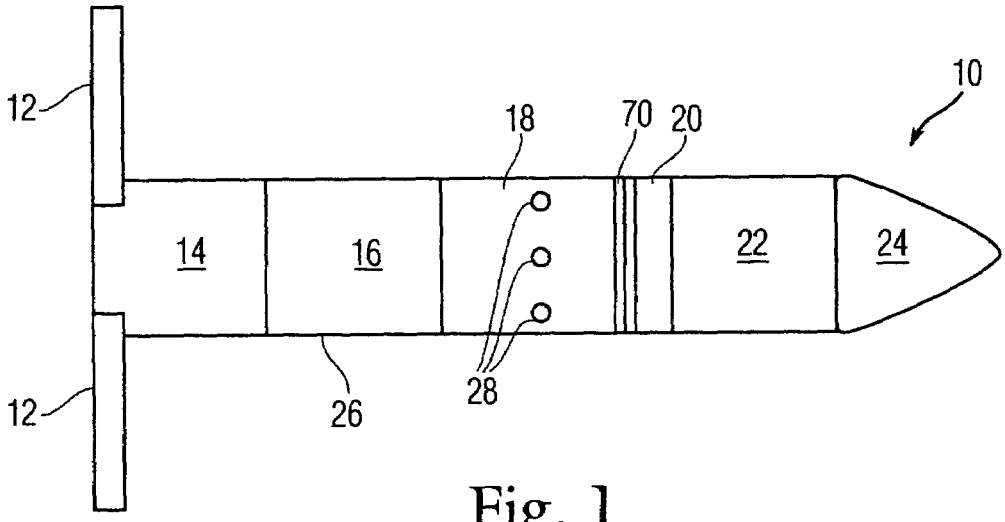
FIG. 1 is a side view of one embodiment of a projectile according to the invention.

The present invention is known as the Light Fighter Lethality Seeker Projectile (LFLSP). The LFLSP includes projectile knowledge of the approximate target location on the battlefield at launch. The projectile is provided this information before launch. Using this target location, the fire control system also calculates the "did hit" initial trajectory which will intercept the target. The time of flight, components of the projectile position and velocity will be transmitted to the projectile. If the projectile's actual trajectory is different from its ideal trajectory, and would cause the projectile to miss the basket to acquire the target downrange then the guidance and control system will initiate a command to correct the ballistic trajectory. In addition, the projectile's imaging seeker is provided with what it will see when it turns on down range, in particular, the location of the target in the scene and the target's relationship to conventional points of reference at the target location from the perspective of ground height prior to launch.

The projectile is gun launched and flies autonomously, under a slow roll, to the target coordinates. The gun launch is designed to be low impulse (3 lb-sec or less), but direct fire. Since the low impulse results in a muzzle velocity too low for a direct fire trajectory to the maximum range of 500 meters, a rocket motor is initiated post launch to increase the velocity to direct fire trajectory velocity. Therefore, after launch, a rocket motor is ignited which provides a boost. During the initial stages of projectile flight, the projectile's guidance and control system determines the projectile's orientation and position and the projectile's deviation from its initial trajectory. The guidance and control system activates the projectile's maneuver mechanism, as required. As the projectile approaches the target, the imaging seeker is first activated and begins to image the scene. The imaging seeker detects and recognizes the target, stationary or moving. The target is expected to move into defilade before the projectile arrives at its location.

With this information, the imaging seeker electronics on board the projectile interface with the guidance and control system that directs the projectile to maneuver and engage the target. The target is typically a human enemy soldier. The target may be a moving human enemy soldier. The invention will compensate for target movement and any shooter aiming errors. The projectile is approximately 25 mm in diameter, 6 inches in length and weighs about 0.5 lbs. The range of the rocket boosted projectile is about 500 meters. The projectile is launched at a muzzle velocity of approximately 190 feet per second and a time of flight to impact is about 4 seconds.

The LFLSP compensates for aim error; variations in muzzle velocity, variations in rocket burnout velocity, movement of the target after launch, and non-standard atmospheric effects on the trajectory. The projectile contains an imaging seeker (not a hot spot or quadrature seeker) which locates the target with respect to fixed reference points in the target area (reference points provided by the fire control system). The projectile tracks the target, maneuvers to burst near a moving target, recognizes when a target has gone to defilade, and flies to and airbursts over the target's defilade location. The inventive projectile increases the probability of a hit and the probability of a kill.

The LFLSP is a fire and forget maneuvering, air burst, small arms projectile with an imaging seeker and a guidance and control system. An important feature of the invention is that the projectile "knows" the approximate target location at launch. The fire control system inputs the target image (with reference points), range, time of flight and components of trajectory position and velocity, and azimuth to the projectile prior to launch. After launch, the projectile uses artificial stability to enhance the projectile' s static stability both at the low initial muzzle velocity and, after rocket boost, to avoid high transient yaw induced by maneuvers. Artificial stability is defined here as reducing an initial yaw by sequential, timed firing of pairs of side thrusters. The projectile flies autonomously to the target's location. The projectile determines and implements, in flight, the trajectory corrections required to approach a target (stationary, moving, or moved to defilade) within the warhead's lethal radius.

In the initial stages of projectile flight, the projectile determines its orientation, position, and course corrections using on-board inertial measuring devices. The projectile also activates maneuver mechanisms (artificial stability) as required to control initial and transient yaw levels. As the projectile approaches the target image capture point the projectile activates the on-board imaging seeker. The imaging seeker recognizes the target scene fixed reference points and the personnel target's thermal image. The imaging seeker locates the target. The projectile maneuvers to correct for target motion and for non-standard atmospheric effects not compensated for by the fire control at launch.

As the projectile further approaches the target the imaging seeker updates the fuze function time based on a comparison of the image's apparent angular size and time rate of change with the fire control generated angular size profile and rate of change. The seeker recognizes if the target goes into defilade and remembers the target's last observed position with respect to the scene fixed reference points. The guidance and control system steers to the target's last observed position and the fuze functions the round as an airburst.

The projectile includes an imaging seeker to locate the target with respect to fixed reference points in the target area, and a maneuver mechanism which, when activated, causes the projectile to change its trajectory to engage the target. Upon closest approach to the target, the dual high explosive warheads will airburst, incapacitating the target.

Figure 3:
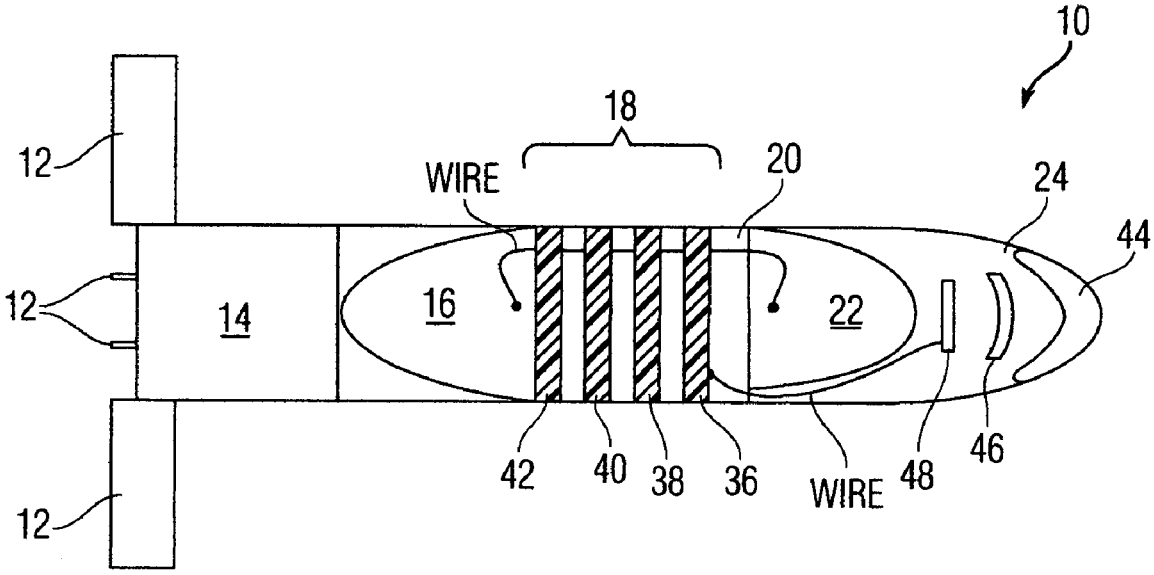
FIG. 3 is a side view of the projectile of FIG. 1 with the shell cut away to show the internal components.

FIG. 1 is a side view of one embodiment of a LFLSP 10 according to the invention. FIG. 3 is a side view of the LFLSP 10 of FIG. 1 with the shell cut away to show the internal components.

The LFLSP is launched from a gun tube using a kickout charge. The LFLSP includes fins 12, a rocket motor 14, a rear warhead 16, an electronics unit 18, a power supply 20, a front warhead 22, an imaging seeker 24, a shell 26 and a maneuver mechanism 28 located on the shell 26. Shell 26 is made of, for example, aircraft type aluminum with a weight of about 62 grams. Shell 26 could also be made of a composite material. Fins 12 are folding fins that are shown in FIG. 1 in the unfolded position.

The fins may be uncontrolled fins used for static stability only, or they may be piezoeletrically controlled and part of the maneuver mechanism. Either rearward folding or folding wrap around fins may be used. The fin blade can be partially or totally canted to provide slow roll rates to the projectile. In addition, tip chord spin tab, or a fin chamfer can also be implemented to provide slow roll rate. The number of fins depends on the static and dynamic stability requirements and can be any multiple, i.e. 4, 6, or 8. The fins 12 unfold after exit from the gun tube. The fins 12 fold forward in the folded position. Preferably, the number of fins is six with a total mass of about 2 grams.

In the embodiment of FIG. 1, the rocket motor 14 is at the rear of the LFLSP 10. The projectile's muzzle velocity (provided by the kickout charge) is insufficient to reach a range of 500 meters. The rocket motor 14 provides thrust for about one second, to boost the projectile's velocity from about 60 meters per second to about 180 meters per second. Thus, the LFLSP can reach a range of 500 meters in a four second time of flight. The amount of rocket propellant required is about 45 grams of a standard HTPB-ammonium perchlorate propellant, with the exact amount varying with the rocket motor position. The rocket motor module is about 3.0 cm long.

Adjacent the rocket motor 14 is the rear warhead 16. By way of example, both the front and rear warheads 16, 22 comprise a hemispherical steel liner, about 2.5 mm thick, scored on the inside surface and filled with a high explosive, such as PBX N5. In one embodiment, the rear warhead has a mass of approximately 50 grams and a length of approximately 2.9 cm.

Figure 2:
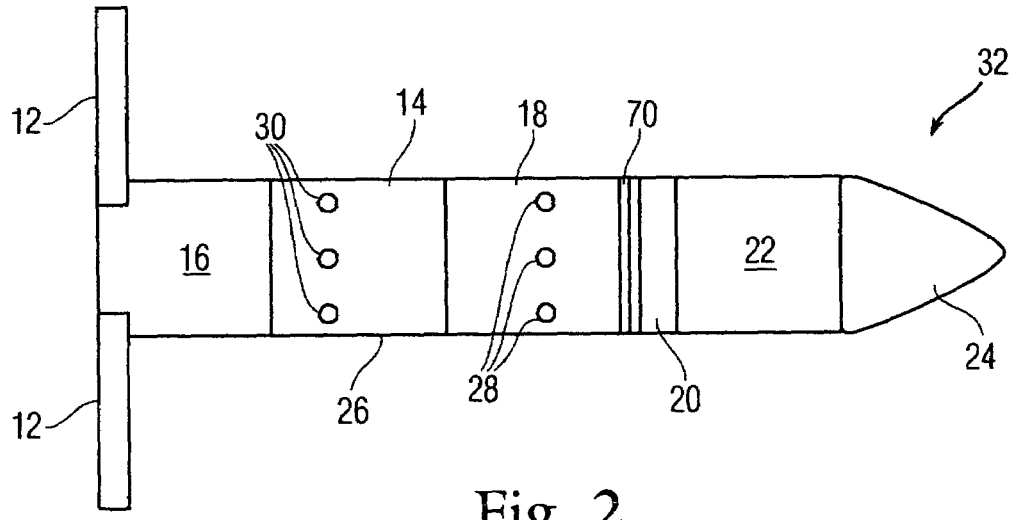
FIG. 2 is a side view of another embodiment of a projectile according to the invention.

FIG. 2 is a side view of another embodiment of a LFLSP 32. In the embodiment of FIG. 2, the rear warhead 16 is located behind the rocket motor 34 rather than in front of the rocket motor 14, as in FIG. 1. All other components of the projectile 32 are the same as in FIG. 1. In FIG. 2, rocket motor 14 includes nozzles 30 spaced circumferentially around projectile 32. The exit faces of nozzles 30 are flush with the outside surface of shell 26 and angled rearward at about 20 to 30 degrees to the longitudinal axis of the projectile 32. Nozzles 30 are circumferentially spaced such that the exhaust gas passes between fins 12.

Referring again to FIG. 1, the maneuver mechanism 28 comprises, for example, a plurality of explosive squibs located circumferentially around the outside of the projectile 10, or a combination of explosive squibs and piezoelectrically controlled fins. The explosive squibs are incorporated into the shell 26 of the projectile 10, preferably on the center of gravity. The squibs may be made by drilling holes in the shell and filling the holes with a primary explosive that is detonated, for example, by a bridge wire. Alternatively, the squibs may be molded into a flexible circuit board that is wrapped around, and bonded to, the shell 26. The number of explosive squibs may be six or more and may have more than one impulse level. The microprocessor determines when to fire the squibs based on the roll angle of the projectile 10 (as determined by the inertial measurement unit in the electronics unit) and by looking at the current image in the imaging seeker 24. If the current image of the target has moved relative to the fixed reference points, or if the entire scene has shifted off center, squibs will be fired to center the target in the imaging seeker's 24 field of view. Alternatively, piezoelectrically controlled fins may be used in combination with squibs as a trajectory control mechanism. In this case the fins" angle of attack would be modulated by the microprocessor based on projectile roll angle as derived from the inertial measurement unit. Since fins are not effective at the launch velocity, they would be augmented with squibs for projectile flight control at low velocity.

Referring to FIGS. 1 and 3, the electronics unit 18 comprises a microprocessor circuit board 36, a voltage regulator circuit board 38, an inertial measurement circuit board 40 and a fuze and safe and arm circuit board 42, all electrically connected to each other. The microprocessor circuit board 36 controls the operation of the projectile 10. The microprocessor circuit board 36 contains video memory (for downloaded target images), an automatic target detection and tracking unit, a main memory for projectile and trajectory parameters, a squib firing, and optionally a piezoelectric fin controller, and a fire control interface for communicating with the external weapon fire control. The fuze and safe and arm circuit board 42 is electrically connected to the front and rear warheads 22, 16 and to the electrically initiated rocket motor 14. The electronics unit 18 is about 2.8 cm long and weighs about 9 grams.

The power supply 20 is typically one or more batteries, or alternatively, a set of high energy density capacitors charged from the weapon fire control. Thermal batteries are not preferred. The spin rate of the fin stabilized projectile 10 is between about 5 to 7 Hz, which is too slow for the electrolyte in a thermal battery to be properly dispersed in the battery cell. In addition, thermal batteries take time to come up to charge once the electrolyte is dispersed in the battery. One type of suitable batteries are zinc-air batteries. Zinc-air batteries are inactive until exposed to air. They have a very high energy density and have been approved for medical use. Zinc-air batteries are available in a variety of sizes, some very small, such as hearing aid size batteries.

The power consumption of the inertial measurement unit circuit board 40 is estimated to be 0.2 watts. Assuming that the microprocessor circuit board 36, voltage regulator circuit board 38 and fuze and safe and arm circuit board 42 also require 0.2 watts, the total power requirement for the electronics unit 18 is 0.8 watts. The power requirements of the imaging seeker 24 and explosive squibs 28 are about 0.1 watts and 0.3 watts, respectively. Thus, the total power requirement is about 1.2 watts. Assuming that hearing aid size batteries are used, the projectile 10 requires six batteries. The six batteries may be stacked in two stacks of three, which will be about 0.6 centimeters long and weigh about 3 grams. Another suitable battery supply is lithium manganese dioxide batteries. Another power supply alternative is a capacitor that is charged while the projectile 10 is in the gun launch tube.

The front warhead 22 is located forward of the electronics unit 18 and behind the imaging seeker 24. Both front and rear warheads 22, 16 are used in the projectile 10 for a proper mass distribution and to obtain the maximum angular spread of fragments. The front warhead 22 has, for example, a mass of about 40 grams and a length of about 2.5 centimeters.

At the front of the projectile 10 is the imaging seeker 24. The imaging seeker 24 comprises an infrared transparent ogive 44, a lens assembly 46 and a detector 48. Detector 48 comprises an uncooled infrared focal plane array (FPA) with associated back plane electronics. The imaging seeker 24 is not a hot spot seeker that looks for the hottest object in the field of view of its sensor. The imaging seeker 24 looks for the thermal signature/characteristics of a standing or moving man. The imaging seeker 24 preferably has an eight degree field of view and a 64 by 64 pixel array. The imaging seeker 24 has sufficient resolution to image the target and the target area reference points from the imaging seeker turn-on point. The target is typically a human being in open or in defilade. It is assumed that the human target can pop up and down and can be exposed for a period of six seconds. When the target runs, it is assumed that it can run at a velocity of two meters per second. The imaging seeker 24 has a length of about 2.7 cm and a weight of about 35 grams.

Figure 4:
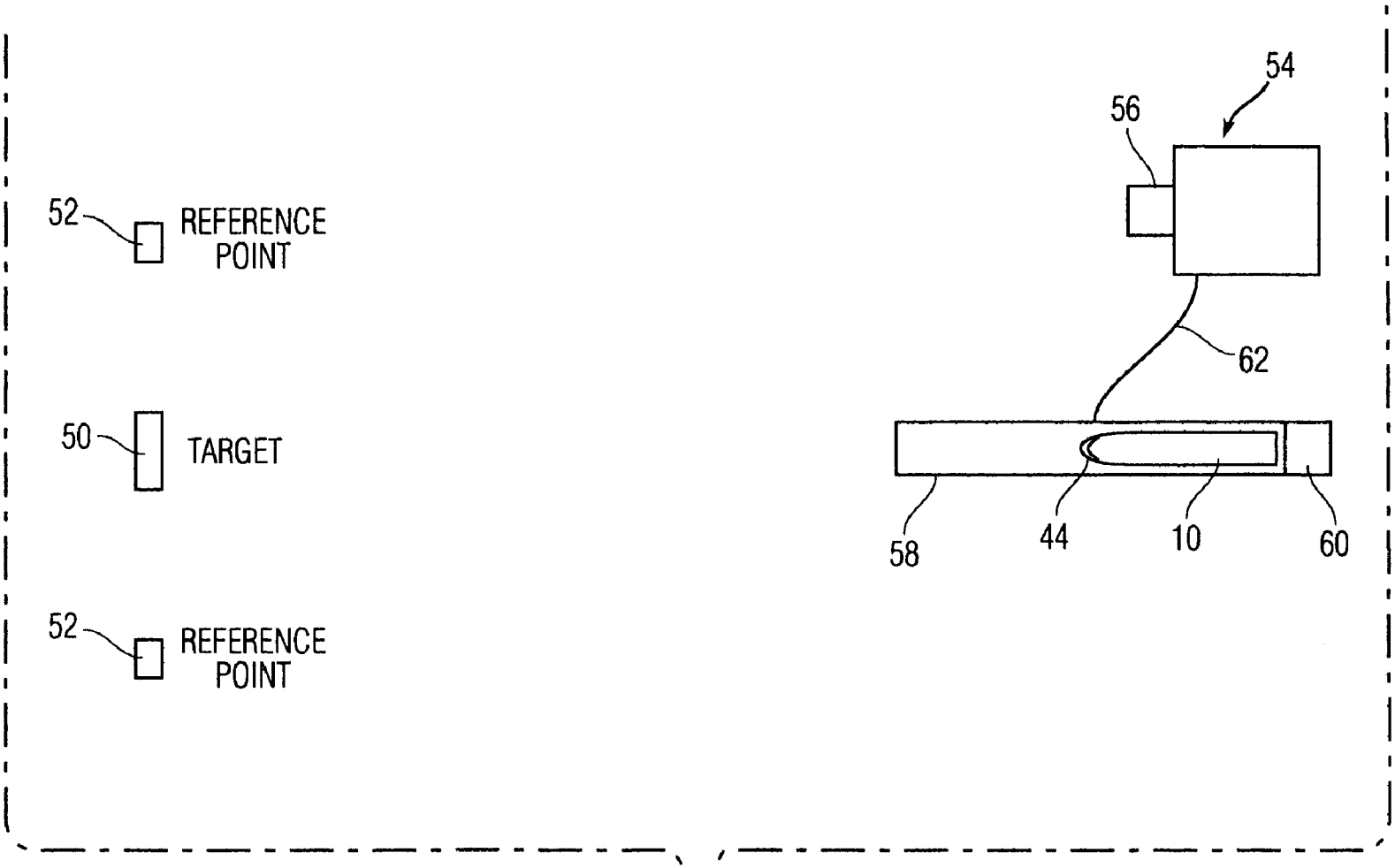
FIG. 4 is a schematic plan view of a battlefield.

Fire Control Transfer of Information FIG. 4 is a schematic plan view of a battlefield. A human target 50 and points of reference 52 are located downrange of the gun launch tube 58. The points of reference may be landmarks such as trees, buildings, etc. External to the projectile 10 is a fire control system 54 including an infrared imager 56. The fire control system 54 will image the target 50 and the conventional points of reference 52 in the field of view. fire control system 54 will resize the image to show what the projectile 10 will "see" approximately half way to the target 50. At approximately half way to the target 50, the imaging seeker 24 of the projectile 10 turns on. resized image created by the fire control system 54 includes the target 50 and the conventional points of reference 52. The resized image is transmitted to the projectile 10 prior to launch.

One method to transmit the resized image from the fire control system 54 to the projectile 10 is optically via a fiber optic cable 62.fiber optic cable 62 is connected at one end to the fire control system 54 and at the other end to the gun launch tube 58. At the gun launch tube 58, the end of fiber optic cable 62 may be mounted in the gun tube at the location of the transparent ogive 44 of the projectile 10 or, alternatively, opposite an optical coupling ring 70 (See FIGS. 1 and 2) embedded in the shell 26 of the projectile 10, adjacent to the microprocessor board in the electronics section 18. In this manner, information is sent at a very high rate to the video memory microprocessor circuit board 36 on board the projectile 10, or, alternatively, to a detector attached to the optical coupling ring 70 on the projectile 10, while the projectile is in the gun tube. After the projectile 10 receives the information, the projectile 10 is launched from the gun tube 58 by the kickout charge 60. When the projectile's imaging seeker 24 turns on half way down range, the imaging seeker 24 looks for the conventional points of reference 52 and for the last known target location with respect to the conventional points of reference 52. The imaging seeker 24 finds the target 50 and the projectile 10 maneuvers to the target 50.

Operation The fire control system 54 passes the target location information to the projectile 10, including a resized image of the target area with target location and reference points 52, in addition to a flight trajectory based on target location at launch. In addition, the "did hit" trajectory, time of flight, components of position and velocity are also passed to the projectile. The projectile 10 is launched. The inertial measurement circuit board 40 integrates the launch acceleration to calculate an actual muzzle velocity. The microprocessor circuit board 36 compares the actual muzzle velocity to a standard muzzle velocity and, based on the comparison, the fuze function time updated. The inertial measurement circuit board 40 detects initial yawing motion and the microprocessor circuit board 36 directs the firing of one or more explosive squibs 28 to dampen the initial angular motion, thereby producing "artificial stability". The rocket motor 14 is then fired. The inertial measurement circuit board 40 integrates the thrust to calculate actual delivered impulse. The microprocessor circuit board 36 compares the actual delivered impulse to a standard impulse and updates the fuze function time to account for any variation in total impulse. The trajectory parameters measured by the inertial measurement circuit board 40 are continuously compared to the pre-stored parameters and course corrections made as necessary.

Terminal homing is needed only to remove the error remaining after midcourse guidance. Thus, the burden on the maneuver mechanism 28, the imaging seeker 24 field of view and the acquisition range is significantly reduced. The imaging seeker 24 is turned on about 250 meters from the target 50. The imaging seeker 24 identifies the target 50 with respect to the pre-stored fixed scene reference points 52 and guides the projectile 10 to the target 50. The microprocessor circuit board 36 may make final corrections to the fuze function time by comparing target apparent angular size and angular rate of change to pre-stored parameters. The projectile 10 will recognize if the target 50 goes into defilade and steer to the target's last observed position. The fuze airbursts the front and rear warheads 22, 16 at the target's location.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A projectile, comprising:

an imaging seeker at a front of the projectile;

a front warhead behind the imaging seeker;

a power supply;

an electronics unit connected to the power supply and comprising a microprocessor circuit board, a voltage regulator circuit board, an inertial measurement circuit board and a fuze and safe and arm circuit board, all electrically connected to each other, the microprocessor circuit board also being connected to the imaging seeker;

a rear warhead, the front and rear warheads being electrically connected to the safe and arm circuit board;

a rocket motor electrically connected to the electronics unit;

foldable fins mounted at the rear of the projectile;

a shell that encases the front warhead, the power supply, the electronics unit, the rear warhead and the rocket motor; and a maneuver mechanism disposed in the shell and electrically connected to the microprocessor circuit board.

2. The projectile of claim 1 wherein the imaging seeker is an infrared imaging seeker.

3. The projectile of claim 1 wherein the front and rear warheads comprise a high explosive.

4. The projectile of claim 1 wherein the shell comprises aluminum.

5. The projectile of claim 1 wherein the rocket motor is behind the rear warhead.

6. The projectile of claim 1 wherein the rear warhead is behind the rocket motor.

7. The projectile of claim 1 wherein the power supply comprises batteries.

8. The projectile of claim 1 wherein the power supply comprises a capacitor.

9. The projectile of claim 1 wherein the maneuver mechanism comprises a plurality of explosive squibs disposed circumferentially around the projectile and radially outward from an approximate center of gravity.

10. The projectile of claim 9 wherein the maneuver mechanism further comprises the foldable fins.

11. The projectile of claim 1 wherein the imaging seeker comprises an infrared transparent ogive, a lens assembly and a detector.

12. A munition comprising:

a fire control system including an infrared imager;

a gun launch tube;

a kickout charge disposed in the gun launch tube;

an optical fiber connecting the fire control system and the gun launch tube; and the projectile of claim 11 disposed in the gun launch tube above the kickout charge.

13. The munition of claim 12 wherein the projectile is positioned in the gun launch tube such that the optical fiber is adjacent the transparent ogive of the imaging seeker.

14. The munition of claim 12 wherein the projectile further comprises an optical coupling ring disposed circumferentially on the outer surface of the projectile and wherein the projectile is positioned in the gun launch tube such that the optical fiber is adjacent the optical coupling ring.

15. A method of using the munition of claim 12, comprising:

scanning an area that includes a target and target reference points using the infrared imager of the fire control system to produce an infrared image;

resizing the infrared image;

transferring the resized infrared image to the projectile;

launching the projectile;

updating a fuze function time based on a comparison of an actual muzzle velocity and a standard muzzle velocity;

damping a projectile angular motion using the maneuver mechanism;

firing the rocket motor;

turning on the imaging seeker;

correcting the projectile course using the maneuver mechanism; and detonating the front and rear warheads at a target location.

16. The method of claim 15 further comprising, after firing the rocket motor, updating the fuze function time based on a comparison of an actual delivered impulse and a standard impulse.

17. The method of claim 15 wherein the step of launching the projectile includes launching the projectile using the kickout charge.

18. The method of claim 15 wherein the step of transferring the resized infrared image to the projectile includes transferring the resized infrared image using the optical fiber.

* * * * *